US009908537B2

(12) United States Patent
Kehl

(10) Patent No.: US 9,908,537 B2
(45) Date of Patent: Mar. 6, 2018

(54) ASSEMBLY DEVICE FOR A SIDE WALL CLADDING ELEMENT OF A RAIL VEHICLE

(71) Applicant: SIEMENS AKTIENGESELLSCHAFT, Munich (DE)

(72) Inventor: Tobias Kehl, Schwanstetten (DE)

(73) Assignee: Siemens Aktiengesellschaft, Munich (DE)

( * ) Notice: Subject to any disclaimer, the term of this patent is extended or adjusted under 35 U.S.C. 154(b) by 231 days.

(21) Appl. No.: 14/780,621

(22) PCT Filed: Feb. 28, 2014

(86) PCT No.: PCT/EP2014/053928
§ 371 (c)(1),
(2) Date: Sep. 28, 2015

(87) PCT Pub. No.: WO2014/154440
PCT Pub. Date: Oct. 2, 2014

(65) Prior Publication Data

US 2016/0031455 A1 Feb. 4, 2016

(30) Foreign Application Priority Data

Mar. 28, 2013 (DE) ..... 10 2013 205 608

(51) Int. Cl.
*B61D 17/00* (2006.01)
*B61D 17/18* (2006.01)
*B61D 1/00* (2006.01)

(52) U.S. Cl.
CPC ..... *B61D 17/00* (2013.01); *B61D 1/00* (2013.01); *B61D 17/18* (2013.01)

(58) Field of Classification Search
CPC ..... B61D 1/00; B61D 13/00; B61D 17/00; B61D 17/005; B61D 17/04; B61D 17/041; B61D 17/043; B61D 17/046; B61D 17/08; B61D 17/10
See application file for complete search history.

(56) References Cited

FOREIGN PATENT DOCUMENTS

| | | | | |
|---|---|---|---|---|
| DE | 1884477 U | | 12/1963 | |
| DE | 4320636 A1 | | 1/1995 | |
| DE | 4445250 A1 | | 2/1996 | |
| DE | 19616442 A1 | | 10/1997 | |
| DE | 102007024804 A1 | | 11/2008 | |
| GB | 3547 | * | 0/1913 | ..... B61D 17/00 |
| GB | 3547 A | | 0/1913 | |

* cited by examiner

*Primary Examiner* — Robert J McCarry, Jr.
(74) *Attorney, Agent, or Firm* — Laurence Greenberg; Werner Stemer; Ralph Locher

(57) ABSTRACT

A rail vehicle includes a side wall cladding element having at least one hook for hooking the side wall cladding element into a guide for securing purposes. The guide is connected in turn to a framework of the rail vehicle.

9 Claims, 2 Drawing Sheets

ASSEMBLY DEVICE FOR A SIDE WALL CLADDING ELEMENT OF A RAIL VEHICLE

BACKGROUND OF THE INVENTION

Field of the Invention

The invention relates to a side wall cladding element for a rail vehicle and to a rail vehicle having a side wall cladding element.

It has been customary up to now to screw side wall cladding elements of a rail vehicle to the framework of the rail vehicle. One example of this is the side wall claddings of the Combino from Siemens AG. In order to connect the side wall cladding elements to the framework in a manner which is secure against vandalism, a multiplicity of individual screw connections are to be provided. This requires a considerable outlay for mounting and possibly dismantling.

BRIEF SUMMARY OF THE INVENTION

The invention is based on the object of proposing a side wall cladding fastening means which is easy to mount, cannot be seen from the passenger compartment of a rail vehicle and is secure against vandalism.

The object is achieved by way of the subject matter of the independent patent claim. Developments and refinements of the invention are found in the features of the dependent patent claims.

A rail vehicle according to the invention, in particular a rail vehicle for passenger transport, comprises a side wall cladding element according to the invention with at least one hook and, for fastening the side wall cladding element to a framework of the rail vehicle, a guide which is configured so as to be complementary with respect to the at least one hook of the side wall cladding element, which guide is connected to a framework of the rail vehicle, and which hook and which guide are configured for hooking the hook of the side wall cladding element into the guide. According to the invention, the hook of the side wall cladding element is hooked into the guide and the side wall cladding element is therefore connected to the framework of the rail vehicle.

Here, the guide can be shaped as an eyelet. If it is a rail, the side wall cladding element can be positioned freely along the rail. It runs, in particular, parallel to the longitudinal axis of the rail vehicle.

The hook is configured, in particular, in such a way that it acts at least perpendicularly on the side wall cladding element, with the result that the side wall cladding element is fixed at least in said direction on the framework of the rail vehicle. If the side wall cladding element is oriented for its part vertically in the rail vehicle, the hook counteracts horizontal displacement of the side wall cladding element away from the guide.

In one development, the at least one hook of the side wall cladding element has a nose which is arranged spaced apart from the side wall cladding element in order to hook in the guide between the nose and the side wall cladding element.

According to one embodiment, the nose of the hook can be deformed elastically, in particular in a direction perpendicularly with respect to the side wall cladding element. As a result, the guide can be clamped in between the side wall cladding element and the hook. By the nose being deformed elastically as a result of hooking in of the guide, in such a way that the spacing from the nose to the side wall cladding element increases, the hook acts like a spring, as a result of which it is prestressed against the guide.

For example, the at least one hook of the side wall cladding element is open toward the bottom. The side wall cladding element is hooked into the guide from above and is correspondingly mounted into the guide in the mounted state. The hook is therefore hooked into the guide counter to the direction of the weight of the side wall cladding element in such a way that a self-locking action is produced and therefore lowering of the side wall cladding element is blocked.

According to a further development of the rail vehicle, the at least one hook of the side wall cladding element is arranged at a lower end of the side wall cladding element. In particular, in order to fasten the side wall cladding element itself, at least two or more hooks are arranged at the lower end of the side wall cladding element for hooking and fastening the side wall cladding element into at least one guide of the rail vehicle, which guide is of complementary configuration with respect to the hooks.

The side wall cladding element for cladding the side walls in the interior, in particular in the passenger compartment, of the rail vehicle extends, in particular, between the floor of the rail vehicle and a ceiling of the rail vehicle. As will still be explained in the following text, it can have a height which is greater than the spacing between the ceiling and the floor of the interior of the rail vehicle.

It is provided in a further development that, in order to fasten itself to the rail vehicle, the side wall cladding element comprises at least one first profiled rail for free positioning of a first holder along the first profiled rail, which first holder is configured in a complementary manner with respect to the first profiled rail, and for fastening of the first holder to the first profiled rail. The first holder is first of all to be positioned freely along the first profiled rail and is subsequently to be connected to the first profiled rail at said position, for example by way of clamping of the first holder on the first profiled rail. Here, the connection comprising the first profiled rail and the first holder is configured in such a way that it is suitable for fastening the side wall cladding element with the at least one first holder to a framework of the rail vehicle. The first holder is then for its part connected, in particular releasably, to the framework of the rail vehicle, for example by way of a screw connection. The first holder can first of all be positioned freely along the first profiled rail of the side wall cladding element. It is clamped, wedged or screwed, in particular, to the profiled rail and is likewise connected releasably to the framework of the rail vehicle, for example by means of a screw connection.

The framework has a limited number of positions for arranging first holders. By way of the first profiled rail, however, side wall cladding elements can be formed in different sizes and/or can be arranged in a variable manner along the longitudinal axis of the rail vehicle.

In order to fasten further cladding elements, in particular ceiling cladding elements, to the side wall cladding element, it can have at least one further, second profiled rail for free positioning of a second holder along the second profiled rail, which second holder is configured in a complementary manner with respect to the second profiled rail, and for fastening of the second holder at the freely selected position of the second profiled rail.

The side wall cladding element comprises both the first and the second profiled rail, as a result of which the further cladding elements are fastened to the side wall cladding element and, as a result, via the side wall cladding element to the framework of the rail vehicle.

The first and/or the second profiled rail are/is advantageously arranged parallel to the longitudinal axis of the rail vehicle. In one development, the first and/or the second profiled rail are/is of C-shaped configuration in cross section. If the first profiled rail of C-shaped configuration has a vertically oriented C-opening and/or the second profiled rail of C-shaped configuration has a horizontally oriented C-opening, the opening of the first profiled rail points upward, in particular, and/or the opening of the second profiled rail points toward the side, in particular into the interior of the rail vehicle, with the result that the first holder can be introduced from above into the first profiled rail and is guided, in particular, in the first profiled rail longitudinally with respect to the longitudinal axis of the rail vehicle, and/or the second holder can be introduced from above into the second profiled rail and is guided, in particular, in the second profiled rail longitudinally with respect to the longitudinal axis of the rail vehicle.

According to a further refinement, the first and/or the second profiled rail are/is arranged at the upper end of the side wall cladding element.

In an advantageous way, the first profiled rail and the second profiled rail are connected to one another in an integrally joined manner, in particular without joints. They are of monolithic configuration, for example, by virtue of the fact that they are manufactured such that they are cast in one piece; in particular, both the first and the second profiled rail are manufactured from one extruded profile.

If merely a single hook is provided for hooking into a guide, it is also dimensioned so as to fasten the side wall cladding element together with the holder or holders to the framework of the rail vehicle. If a plurality of hooks are provided, they secure the side wall cladding element jointly and can therefore be of corresponding configuration. If, in addition, merely a first holder is provided for fastening the side wall cladding element to a framework of the rail vehicle, both the single, first holder and the first profiled rail are dimensioned in such a way that they secure the side wall cladding element with a predefined mass on their own. In particular, however, two or more first holders for fastening the side wall cladding element are connected to the first profiled rail and the framework of the rail vehicle.

Moreover, in order to fasten itself, the side wall cladding element can also be provided with a plurality of sections of a first component of a hook and loop fastener which consists of two components, in particular in vertically arranged strips, in particular on the sides or edges of the side wall cladding element, in particular along its vertical axis, perpendicularly with respect to the longitudinal axis of the rail vehicle. Sections of the other, second component of the hook and loop fastener are then arranged correspondingly on the framework, for example on door and/or window pillars. The first sections of the first component of the hook and loop fastener are arranged on a rear side of the side wall cladding element, which rear side faces away from the interior, in particular the passenger compartment, of the rail vehicle. The second sections of the second component of the hook and loop fastener are attached correspondingly on a side of the framework, which side points into the vehicle interior.

If the side wall cladding element is introduced in a hooking manner into the lower rail during mounting, it can subsequently be fixed on the framework by way of the hook and loop fasteners, in order subsequently to fasten it to the rail vehicle by way of the first holders.

One development of the rail vehicle according to the invention provides that the rail vehicle has an interior, in particular a passenger compartment, with a floor, which floor is curved upward in the region of the side wall cladding element and at the edge of which the guide for hooking in the hook is arranged in the region of the side wall. The floor extends laterally at least as far as the side walls of the rail vehicle which are formed at least partially by side wall cladding elements according to the invention. In particular, the floor extends as far as the other side of the side wall cladding elements. It is elevated at the sides. Its lateral edges therefore form upwardly pointing terminating edges. At least one guide for hooking in at least one side wall cladding element is arranged at a lateral edge of the floor. The lateral edge of the floor is therefore situated between the framework of the rail vehicle and the side wall cladding element, with the result that the nose of the hook is arranged on that side of the floor which lies opposite the interior, and in particular bears against the guide on said side. As has already been mentioned above, the guide is advantageously configured as a rail for free positioning of the side wall cladding element along the guide.

According to a further development, the rail vehicle comprises a seal in the region of the side wall, which seal is arranged between the floor and the side wall cladding element and is prestressed sealingly against the side wall cladding element. The sealing lip is fastened, for example, to the floor, but can also be arranged directly on the guide. In addition or as an alternative, an identically functioning seal is arranged on the side wall cladding element. The sealing lip points, in particular, into the interior of the rail vehicle.

BRIEF DESCRIPTION OF THE SEVERAL VIEWS OF THE DRAWING

The invention allows numerous embodiments. It will be explained in greater detail using the following figures, in which in each case one exemplary embodiment is shown. Identical elements in the figures are provided with identical designations.

DESCRIPTION OF THE INVENTION

Figure 1:
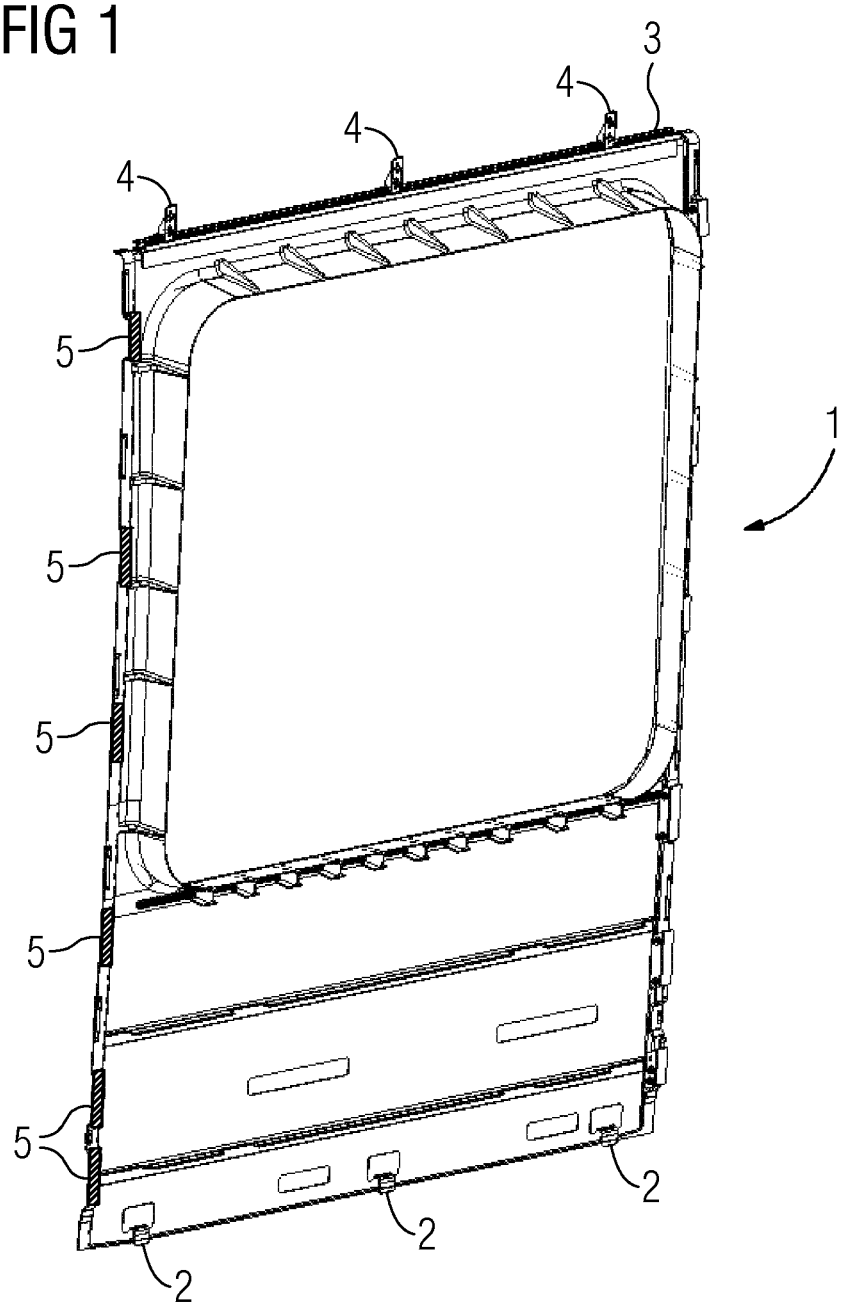
FIG. 1 perspectively shows a side wall cladding element according to the invention from the side which points toward the outer shell of a rail vehicle.

FIG. 1 shows a side wall cladding element 1 according to the invention. In order to fasten itself to a framework of a rail vehicle, said side wall cladding element 1 has three hooks 2 at its lower end for hooking the side wall cladding element 1 into a guide which is configured in a complementary manner with respect to the hooks and for its part is fastened to the framework of the rail vehicle, as a result of which the side wall cladding element 1 is also fastened to the framework of the rail vehicle. As an object to be hooked in, the guide, for example configured as a rail parallel with respect to the longitudinal axis of the rail vehicle, forms the counterpart to the hooks 2 and is not shown in greater detail here.

At its upper end, the side wall cladding element 1 has a first profiled rail 3, in which three first holders 4 are guided here. The first profiled rail 3 serves for free positioning of the first holders 4 along the first profiled rail 3, which first holders 4 are configured in a complementary manner with respect to the first profiled rail 3, and for fastening the first holders 4 to the first profiled rail 3. The first holders 4 are configured such that they can be connected releasably to the first profiled rail 3. They are clamped, wedged or screwed, for example, to the first profiled rail 3. In addition, they can be connected, in particular releasably, to the framework of the rail vehicle, for example by way of a screw connection.

In addition, a plurality of sections of a first component of a hook and loop fastener, consisting of two components, are applied laterally on the side wall cladding element 1, in vertically running strips 5 here. They likewise serve to fasten the side wall cladding element 1 to the framework of the rail vehicle. The sections of the other, second component of the hook and loop fastener which are arranged correspondingly on door and/or window pillars are not shown here.

When the side wall cladding element 1 which is outlined here is mounted, first of all the hooks 2 are hooked into the guide and the side wall cladding element 1 is oriented. First fixing takes place by means of hook and loop fasteners 5. The first holders 4 in the first profiled rail 3 are subsequently connected to the framework, in particular releasably by means of screw connections. If a double action profiled rail or a second profiled rail 6 is provided, ceiling elements 8 with second holders 7 can subsequently be oriented thereon and can be connected to it, as a result of which they are connected via the side wall cladding element 1 to the framework of the rail vehicle.

Figure 2:
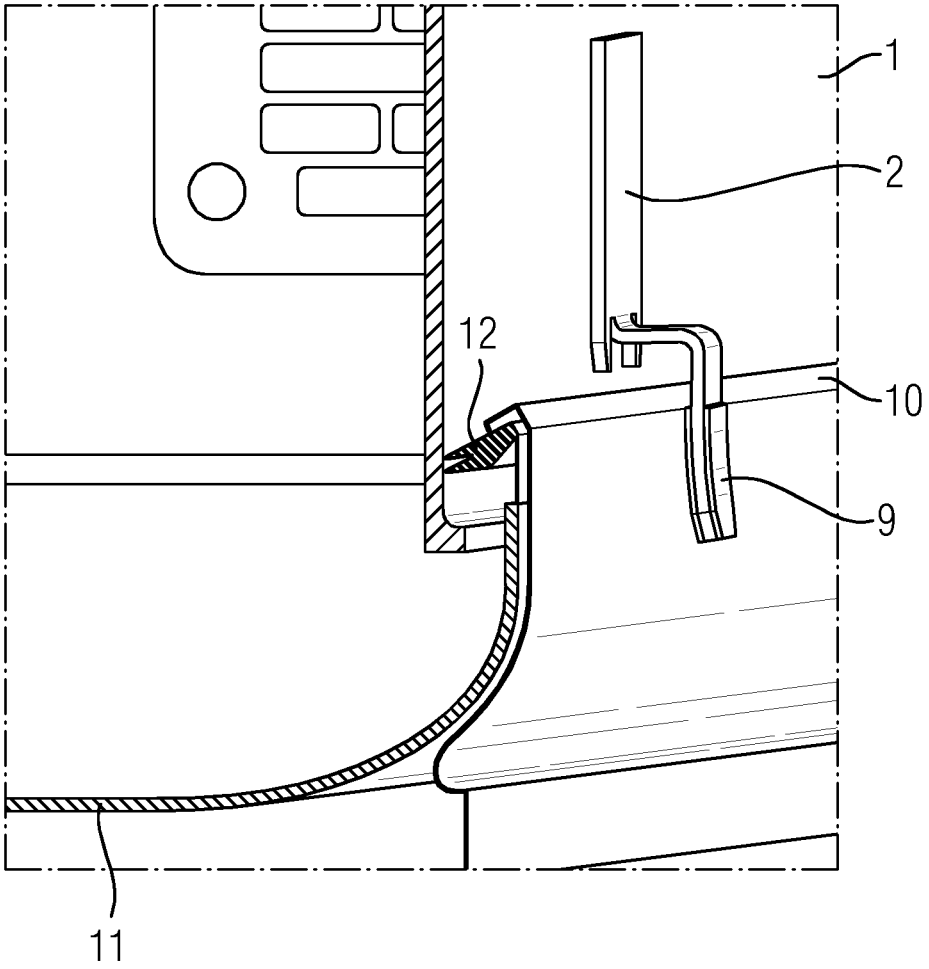
FIG. 2 shows a detailed section of a fastening mechanism of the side wall cladding element according to the invention.

FIG. 2 illustrates in a detailed manner the fastening of a side wall cladding element 1 according to the invention to a rail vehicle. At its upper end, the side wall cladding element 1 has a hook 2. The hook 2 is hooked into a guide 10 of the rail vehicle, which guide 10 is configured in a complementary manner with respect to the hook 2.

To this end, the hook 2 has a nose 9 which runs substantially parallel to the side wall cladding element 1. At its lower end, it points away somewhat from the side wall cladding element 1, in order for the guide 10 to be hooked in easily. With the side wall cladding element 1, it therefore forms a wedge-shaped opening for receiving the guide 10. Here, the hook 2 is bent in an angular manner, but can also be formed in a curved manner. With the side wall cladding element 1, the nose 9 of the hook 2 forms a fork which is open toward the bottom here for hooking into the guide 10. The guide 10 is hooked into the fork between the side wall cladding element 1 and the nose 9 of the at least one hook 2 and is clamped fixedly by way of an elastic deformation of the nose 9. Here, the guide 10 is configured as a rail which guides the side wall cladding element 1 in the longitudinal or driving direction of the rail vehicle. It is situated at the edge of a floor 11 which is curved upward in the region of the side wall cladding element 1. Here, the floor 11 is part of the framework of the rail vehicle or is connected directly to the latter. As a result, the guide 10 for hooking in the hook 2 for fastening the side wall cladding element 1 to the framework of the rail vehicle is likewise part of the framework or is connected directly to the latter. The floor 11 forms a shell which is curved once here. In further embodiments, it can also assume the shape of a shell which is curved twice. If the floor is also curved upward on its end sides, it is of tub-shaped configuration.

A sealing lip 12 which points inward into the vehicle interior is arranged between the guide 10, and therefore between the floor 11 which is elevated and points upward with its lateral edges, and the side wall cladding element 1. In the mounted state which is shown here, said sealing lip 12 is prestressed against the side wall cladding element 1, in order to seal the side wall cladding element 1 and the floor 11. The sealing lip 12 is mounted on the floor 11. As an alternative, it is mounted on the side wall cladding element 1 and is prestressed against the upwardly curved floor 11 or the guide 10.

The invention claimed is:

1. A rail vehicle, comprising:

a rail vehicle framework;

a guide connected to said framework;

at least one side wall cladding element; and at least one hook disposed on said at least one side wall cladding element for fastening said at least one side wall cladding element by hooking said at least one side wall cladding element into said guide;

said guide being constructed as a rail for free positioning of said at least one side wall cladding element along said guide.

2. The rail vehicle according to claim 1, wherein said at least one hook has a nose spaced apart from said at least one side wall cladding element to hook-in said guide between said nose and said at least one side wall cladding element.

3. The rail vehicle according to claim 1, wherein said at least one hook is disposed at a lower end of said at least one side wall cladding element.

4. The rail vehicle according to claim 1, wherein said at least one hook is open toward the bottom.

5. The rail vehicle according to claim 1, wherein said at least one side wall cladding element has first sections of a hook and loop fastener to be attached to second sections of said hook and loop fastener connected to said framework, for fastening of said at least one side wall cladding element.

6. The rail vehicle according to claim 1, which further comprises an interior with a floor, said floor being curved upward in a vicinity of said at least one side wall cladding element and said floor having an edge at which said guide) is disposed in a vicinity of said side wall cladding element for hooking-in said at least one hook.

7. The rail vehicle according to claim 6, wherein said floor has a seal in a vicinity of said at least one side wall cladding element, said seal being disposed between said floor and said at least one side wall cladding element and being prestressed sealingly against said side wall cladding element.

8. The rail vehicle according to claim 1, which further comprises:

a first holder connected to said framework;

said at least one side wall cladding element having a first profiled rail for free positioning of said first holder along said first profiled rail; and said first holder being configured in a complementary manner with respect to said first profiled rail, for fastening of said first holder to said at least one side wall cladding element.

9. The rail vehicle according to claim 8, wherein said first profiled rail is disposed at an upper end of said at least one side wall cladding element.

* * * * *